US010330389B2

(12) United States Patent
Salters et al.

(10) Patent No.: US 10,330,389 B2
(45) Date of Patent: Jun. 25, 2019

(54) COOLING APPARATUS FOR COOLING A FLUID BY MEANS OF SURFACE WATER

(71) Applicant: KONINKLIJKE PHILIPS N.V., Eindhoven (NL)

(72) Inventors: Bart Andre Salters, Eindhoven (NL); Johannes Antonius Kroeze, Tilburg (NL); Roelant Boudewijn Hietbrink, Utrecht (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 160 days.

(21) Appl. No.: 15/534,588

(22) PCT Filed: Dec. 4, 2015

(86) PCT No.: PCT/EP2015/078620
§ 371 (c)(1),
(2) Date: Jun. 9, 2017

(87) PCT Pub. No.: WO2016/091735
PCT Pub. Date: Jun. 16, 2016

(65) Prior Publication Data

US 2017/0350653 A1 Dec. 7, 2017

(30) Foreign Application Priority Data

Dec. 12, 2014 (EP) ..... 14197744
Mar. 20, 2015 (EP) ..... 15160121
Mar. 27, 2015 (EP) ..... 15161284

(51) Int. Cl.
*F01P 3/20* (2006.01)
*F28D 1/02* (2006.01)
(Continued)

(52) U.S. Cl.
CPC ..... *F28D 1/022* (2013.01); *F01P 3/207* (2013.01); *F28D 1/0475* (2013.01); *F28F 19/00* (2013.01);
(Continued)

(58) Field of Classification Search
CPC ..... F28F 19/02; F28F 2245/08; F28F 19/00; F28F 2245/00; F28F 2265/20;
(Continued)

(56) References Cited

U.S. PATENT DOCUMENTS 3,634,025 A * 1/1972 Landry ..... A61L 2/10 250/372
4,474,228 A * 10/1984 Rogalski ..... B63G 8/36 165/104.14
(Continued)

FOREIGN PATENT DOCUMENTS

DE 102008029464 A1 1/2010
EP 2485003 A1 8/2012
(Continued)

*Primary Examiner* — Frantz F Jules
*Assistant Examiner* — Jose O Class-Quinones

(57) ABSTRACT

A cooling apparatus (1) for cooling a fluid by means of surface water comprises a plurality of tubes (10) for containing and transporting the fluid to be cooled in their interior, the tubes (10) being intended to be at least partially exposed to the surface water during operation of the cooling apparatus (1). Furthermore, the cooling apparatus (1) comprises a plurality of light sources (21, 22) for producing light that hinders fouling of the exterior of the tubes (10), the light sources (21, 22) being dimensioned and positioned with respect to the tubes (10) so as to cast anti-fouling light over the exterior of the tubes (10), wherein the light sources (21, 22) have a generally elongated shape, and wherein the light sources (21, 22) are arranged in at least two mutually different orientations in the cooling apparatus (1).

14 Claims, 2 Drawing Sheets

(51) Int. Cl.

| | |
|---|---|
| ***F01P 11/06*** | (2006.01) |
| ***F28D 1/047*** | (2006.01) |
| ***F28D 21/00*** | (2006.01) |
| ***F28F 19/00*** | (2006.01) |
| ***F28F 19/02*** | (2006.01) |

(52) U.S. Cl.
CPC ..... *F28F 19/02* (2013.01); *F01P 2011/063* (2013.01); *F01P 2050/06* (2013.01); *F28D 2021/0094* (2013.01); *F28F 2245/00* (2013.01); *F28F 2245/06* (2013.01); *F28F 2265/20* (2013.01)

(58) Field of Classification Search
CPC .. F28D 1/022; F28D 1/0206; F28D 2021/004; F28D 1/0475; F01P 3/207; F01P 2011/063; F01P 2050/06
USPC ..... 422/6, 23, 24
See application file for complete search history.

(56) References Cited

U.S. PATENT DOCUMENTS 4,482,809 A * 11/1984 Maarschalkerweerd ..... A61L 2/10 250/435
4,990,313 A * 2/1991 Pacosz ..... F24F 3/166 422/121
5,019,256 A * 5/1991 Ifill ..... B01J 19/123 210/192
5,308,505 A 5/1994 Titus et al.
5,334,347 A * 8/1994 Hollander ..... A61L 9/20 250/455.11
6,182,461 B1 * 2/2001 Washburn ..... A61L 9/205 62/264
6,245,293 B1 * 6/2001 Fencl ..... A61L 2/10 134/1
6,267,924 B1 * 7/2001 Fencl ..... A61L 2/10 165/95
6,550,257 B1 * 4/2003 Goetzinger ..... F24F 3/166 62/291
2007/0144893 A1 * 6/2007 Van Boxtel ..... B63H 21/14 204/196.01
2013/0048877 A1 * 2/2013 Thoren ..... G02B 6/102 250/492.1
2014/0196745 A1 7/2014 Whelan et al.

FOREIGN PATENT DOCUMENTS

JP 5023502 A 2/1993
JP 0978552 A 3/1997
JP 2003502072 A 1/2003
WO 2001025086 A1 4/2001
WO WO-0125086 A1 * 4/2001 ..... F01P 3/207

* cited by examiner

COOLING APPARATUS FOR COOLING A FLUID BY MEANS OF SURFACE WATER

CROSS-REFERENCE TO PRIOR APPLICATIONS

This application is the U.S. National Phase application under 35 U.S.C. § 371 of International Application No. PCT/EP2015/078620, filed on 4 Dec. 2015, which claims the benefit of European Patent Application No. 14197744.7, filed on 12 Dec. 2014, European Patent Application No. 15160121.8, filed on 20 Mar. 2015 and European Patent Application No. 15161284.3, filed on 27 Mar. 2015. These applications are hereby incorporated by reference herein.

FIELD OF THE INVENTION

In general, the invention relates to a cooling apparatus for cooling a fluid by means of surface water, which is adapted for the prevention of fouling, commonly referred to as anti-fouling. In particular, the invention relates to a cooling apparatus for cooling a fluid by means of surface water, comprising a plurality of tubes for containing and transporting the fluid to be cooled in their interior, the tubes being intended to be at least partially exposed to the surface water during operation of the cooling apparatus. An example of such a cooling apparatus is a box cooler which is intended to be used in an engine-driven ship for cooling the fluid of an engine cooling system of the ship.

BACKGROUND OF THE INVENTION

Biofouling or biological fouling is the accumulation of microorganisms, plants, algae, small animals and the like on surfaces. According to some estimates, over 1,800 species comprising over 4,000 organisms are responsible for biofouling. Hence, biofouling is caused by a wide variety of organisms, and involves much more than an attachment of barnacles and seaweeds to surfaces. Biofouling is divided into micro fouling which includes biofilm formation and bacterial adhesion, and macro fouling which includes the attachment of larger organisms. Due to the distinct chemistry and biology that determine what prevents them from settling, organisms are also classified as being hard or soft. Hard fouling organisms include calcareous organisms such as barnacles, encrusting bryozoans, mollusks, polychaetes and other tube worms, and zebra mussels. Soft fouling organisms include non-calcareous organisms such as seaweed, hydroids, algae and biofilm "slime". Together, these organisms form a fouling community.

In several situations, biofouling creates substantial problems. Biofouling can cause machinery to stop working, water inlets to get clogged, and heat exchangers to suffer from reduced performance. Hence, the topic of anti-fouling, i.e. the process of removing or preventing biofouling, is well-known. In industrial processes involving wetted surfaces, bio dispersants can be used to control biofouling. In less controlled environments, fouling organisms are killed or repelled with coatings using biocides, thermal treatments or pulses of energy. Nontoxic mechanical strategies that prevent organisms from attaching to a surface include choosing a material or coating for causing the surface to be slippery, or creating nanoscale surface topologies similar to the skin of sharks and dolphins which only offer poor anchor points.

Anti-fouling arrangements for cooling units that cool the water from a cooling water system of an engine-driven ship by means of seawater are known in the art. For example, DE 102008029464 relates to a box cooler for use in ships and on offshore platforms, comprising an integrated anti-fouling system for killing fouling organisms by means of an overheating process that can be regularly repeated. In particular, the box cooler is protected against microorganism fouling by continuously overheating a defined number of heat exchanger tubes without interrupting the cooling process, wherein waste heat from the cooling water may be used for doing so.

A box cooler is a specific type of heat exchanger which is designed for use in an engine-driven ship. For example, in the case of a tugboat having an installed engine power of 15 MW, one or more box coolers are applied for transferring heat in the order of 5 MW to the seawater. Typically, for the purpose of accommodating the tubes of a box cooler, a ship has a compartment that is defined by a portion of the hull of the ship and partition plates. Entry and exit openings are arranged in the hull at the position of the compartment so that seawater can enter the compartment, flow over the tubes in the compartment, and exit the compartment through natural flow and/or under the influence of motion of the ship. The box cooler comprises bundles of U-shaped tubes for conducting a fluid to be cooled, ends of leg portions of the tubes being secured to a common plate having openings for providing access to both leg portions of each of the tubes. The environment of a box cooler is ideally suited for biofouling, as the seawater is heated to a medium temperature in the vicinity of the tubes as a result of the heat exchange with the relatively hot fluid in the interior of the tubes, and the constant flow of water continuously brings in new nutrients and organisms.

Biofouling of box coolers causes severe problems. The main issue is a reduced heat transferring capability as layers of biofouling are effective heat isolators. When the biofouling layers are so thick that seawater can no longer circulate between adjacent tubes of the box cooler, an additional deteriorating effect on the heat transfer is obtained. Thus, biofouling of box coolers increases the risk of engine over-heating, so that ships need to slow down or ship engines get damaged.

SUMMARY OF THE INVENTION

It is an object of the invention to provide a cooling apparatus which is capable of effective anti-fouling without requiring much maintenance or polluting the seawater with ions, toxic substances, etc. The object is achieved by means of a cooling apparatus for cooling a fluid by means of surface water, which comprises the plurality of tubes as mentioned earlier, and which furthermore comprises a plurality of light sources for producing light that hinders fouling of the exterior of the tubes, the light sources being dimensioned and positioned with respect to the tubes so as to cast anti-fouling light over the exterior of the tubes, wherein the light sources have a generally elongated shape, and wherein the light sources are arranged in at least two mutually different orientations in the cooling apparatus.

According to the invention, anti-fouling is realized by using light. In particular, the light sources of the cooling apparatus may be chosen to produce ultraviolet light, specifically ultraviolet light of the c type, which is also known as UVC light, and even more specifically, light with a wavelength roughly between 250 nm and 300 nm. It has been found that most fouling organisms are killed, rendered inactive, or rendered unable to reproduce by exposing them to a certain dose of the ultraviolet light. A typical dose which appears to be suitable for realizing anti-fouling is 10 mWh per square meter. A very efficient source for producing UVC light is a low pressure mercury discharge lamp, in which an average of 35% of input power is converted to UVC power. Another useful type of lamp is a medium pressure mercury discharge lamp. The lamp may be equipped with an envelope of special glass for filtering out ozone-forming radiation. Furthermore, a dimmer may be used with the lamp if so desired. Other types of useful UVC lamps are dielectric barrier discharge lamps, which are known for providing very powerful ultraviolet light at various wavelengths and at high electrical-to-optical power efficiencies, and LEDs. In respect of the LEDs, it is noted that they can generally be included in relatively small packages and consume less power than other types of light sources. LEDs can be manufactured to emit (ultraviolet) light of various desired wavelengths, and their operating parameters, most notably the output power, can be controlled to a high degree.

Regardless of the type of light source, the light sources which are applied in the cooling apparatus according to the invention have a generally elongated shape. As used in this text in order to indicate the shape of light sources, the term "elongated" should be understood such as to imply that each of the light sources can be said to extend in a longitudinal direction, which may be a straight direction, although this is not necessary within the framework of the invention. In general, an elongated light source may be denoted as being a light source which is adapted to emit a substantial part of its light substantially perpendicular to the longitudinal direction thereof, i.e. in a radial direction when the longitudinal direction is taken as an axial direction of a cylindrical coordinate system associated with the light source. Examples of elongated light sources include tubular lamps, lamps having a number of interspaced point light sources arranged in a line configuration, lamps having a number of LEDs arranged in a strip-like fashion, wherein the LEDs do not necessarily need to be arranged in an abutting fashion, and assemblies of at least one lamp, LED or other device for emitting light with a tubular light guide.

In a cooling apparatus such as a box cooler, comprising a plurality of elongated tubes, numerous possibilities exist for positioning the light sources with respect to the tubes. In the context of the invention, it has been found that already good anti-fouling results can be obtained when the light sources are arranged in one orientation in the cooling apparatus, but that even better anti-fouling results can be obtained when the light sources are arranged in two mutually different orientations in the cooling apparatus, meaning that the longitudinal axes of the light sources extend in two mutually different directions. Apparently, by having two groups of light sources in the cooling apparatus, wherein the light sources of the one group are arranged in a first orientation, and wherein the light sources of the other group are arranged in a second orientation which is significantly different from the first orientation so that the orientations can be classified as being mutually different orientations, an advantageous distribution of light over the tubes is obtained. As a result, the number of light sources to be used in the cooling apparatus for realizing anti-fouling of the entire apparatus can be minimized, so that anti-fouling according to the invention involves minimal energy consumption. It turns out that in practical cases, on the basis of an appropriate choice of the first direction and the second direction, wherein the directions may particularly be perpendicular to each other, it can be so that the total number of light sources needed for obtaining anti-fouling results as desired is lower when the light sources are arranged in the two mutually different orientations as mentioned, compared to a situation in which the light sources are arranged in only a single orientation.

In many practical cases, including the case in which the cooling apparatus is provided in the form of a box cooler, at least a part of the cooling apparatus has a layered structure in which the tubes are arranged in tube layers, each layer including at least one tube. In those cases, it appears to be advantageous when light sources of a first group of the light sources are positioned such as to intersect at least two adjacent tube layers, so that each light source of the first group of the light sources can be used for casting light on a number of tubes, and can be effective in a number of tube layers. Furthermore, it appears to be advantageous for light sources of a second group of the light sources to be arranged between at least one pair of two adjacent tube layers without intersecting those tube layers. By having the two groups of the light sources in the cooling apparatus, it is realized that the light sources are arranged in two clearly distinct ways in the cooling apparatus, wherein an advantageous distribution of light over the tubes is obtained, so that improved anti-fouling can be realized by operating less light sources requiring less input power as compared to having an arrangement of only similarly directed light sources.

In respect of many practical cases, including the case in which the cooling apparatus is provided in the form of a box cooler, it is true that at least a part of the tubes of the respective tube layers is a substantially straight part extending in a main tube direction. A substantially straight shape of the light sources of the second group of the light sources and an arrangement of those light sources in an orientation for extending in a direction which is different from the main tube direction contribute to obtaining optimal anti-fouling effects by means of the light sources. In particular, the light sources of the second group of the light sources may be arranged in an orientation for extending in a direction which is substantially perpendicular to the main tube direction. In any case, the light sources of the second group of the light sources may be arranged in an orientation for being substantially parallel to the tube layers. A substantially straight shape of the light sources of the first group of the light sources and an arrangement of those light sources in an orientation for extending in a direction which is substantially perpendicular to both the main tube direction and the direction of the orientation of the light sources of the second group of the light sources are further factors in obtaining optimal anti-fouling effects by means of the light sources. In other words, it is practical and effective for the light sources of the two groups to extend substantially perpendicular with respect to each other, in directions which are substantially perpendicular to the main tube direction as well. It is furthermore practical and effective for the light sources of the first group of the light sources to extend substantially parallel to each other and/or for the light sources of the second group of the light sources to extend substantially parallel to each other.

An elongated shape, particularly a substantially straight shape of the light sources can be realized by providing the light sources in the form of a tubular lamp, more or less comparable to a well-known TL (tube luminescent/fluorescent) lamp. For various known germicidal tubular UVC lamps, the electrical and mechanical properties are comparable to those properties of tubular lamps for producing visible light. This allows the UVC lamps to be operated in the same way as the well-known lamps, wherein an electronic or magnetic ballast/starter circuit may be used, for example.

The tubes of the respective tube layers of the cooling apparatus may have any suitable shape. Besides the option of the tubes having a substantially straight shape, the option of the tubes having a curved shape exists within the framework of the invention as well, wherein at least one portion of the tube is bent. In such a case, it may be so that at least a number of the light sources of the first group of the light sources are arranged inside of the curved shape of at least a number of the tubes of the respective tube layers. When the curved shape is a U shape, for example, it can be achieved that several portions of the tubes are subjected to the light. Additionally or alternatively, it may be so that at least a number of the light sources of the first group of the light sources are arranged outside of the curved shape of at least a number of the tubes of the respective tube layers. In particular, in respect of the arrangement of the light sources inside of the curved shape of at least a number of the tubes, it is noted that in case the tube layers include a number of U-shaped tubes having a curved bottom portion and two substantially straight leg portions, wherein the tubes of a tube layer have mutually different sizes, ranging from a smallest tube to a largest tube, the smallest tube having a smallest radius of the bottom portion, and the largest tube having a largest radius of the bottom portion, wherein top sides of the leg portions of the tubes are at a similar level in the cooling apparatus, and wherein the leg portions of the tubes extend substantially parallel to each other, as is the case in a box cooler, for example, it is advantageous if at least one light source of the first group of the light sources is arranged inside of the U shape of the smallest tubes of at least a number of the respective tube layers, wherein it may furthermore be true that a number of the light sources of the first group of the light sources are arranged outside of the curved shape of at least a number of the tubes of the respective tube layers, as mentioned.

In an embodiment of the cooling apparatus, the tubes are at least partially coated with an anti-fouling light reflective coating, whereby anti-fouling light can be made to reflect on the tubes in a diffuse way, which contributes to effective distribution of the light over the tubes.

The invention also relates to a ship, comprising an engine for driving the ship, an engine cooling system including a cooling apparatus as described in the foregoing, i.e. a cooling apparatus comprising a plurality of elongated anti-fouling light sources that are arranged in at least two mutually different orientations in the cooling apparatus, and a compartment for accommodating the tubes and the light sources of the cooling apparatus, the compartment being provided with at least one entry opening for allowing water to enter the compartment and at least one exit opening for allowing water to exit the compartment. In the ship, the interior of walls delimiting the compartment may be at least partially coated with an anti-fouling light reflective coating, whereby a contribution can be made to the effectiveness of the distribution of the anti-fouling light over the cooling apparatus. For the sake of completeness, it is noted that all of the options as described in the foregoing with respect to the cooling apparatus according to the invention are equally applicable when the cooling apparatus is used in a ship.

It is a general advantage of the way in which anti-fouling is realized when the invention is applied that the microorganisms are prevented from adhering and rooting on the surface of the tubes of the cooling apparatus. Contrariwise, when known poison dispersing coatings are applied, the anti-fouling effect is achieved by killing the microorganisms after they have adhered and rooted on the surface. Prevention of biofouling by means of light treatment is preferred over removal of biofouling by means of light treatment, as the latter requires more input power and involves a higher risk that the light treatment is not sufficiently effective. In view of the fact that applying the invention involves only a relatively low level of input power, the light sources may be operated to continuously produce anti-fouling light across a large surface without extreme power requirements, or the light sources may be operated at a duty cycle, e.g. 50% of the time on and 50% of the time off, wherein the time intervals may be chosen to be minutes, hours, or whatever is appropriate in a given situation. As not much additional power is required, the invention can be easily applied in existing structures.

The above-described and other aspects of the invention will be apparent from and elucidated with reference to the following detailed description of a box cooler comprising a plurality of tubes for containing and transporting the fluid to be cooled in their interior and a plurality of light sources for casting anti-fouling light on the tubes.

BRIEF DESCRIPTION OF THE DRAWINGS

The invention will now be explained in greater detail with reference to the figures, in which equal or similar parts are indicated by the same reference signs, and in which.

DETAILED DESCRIPTION OF THE EMBODIMENTS

Figure 1:
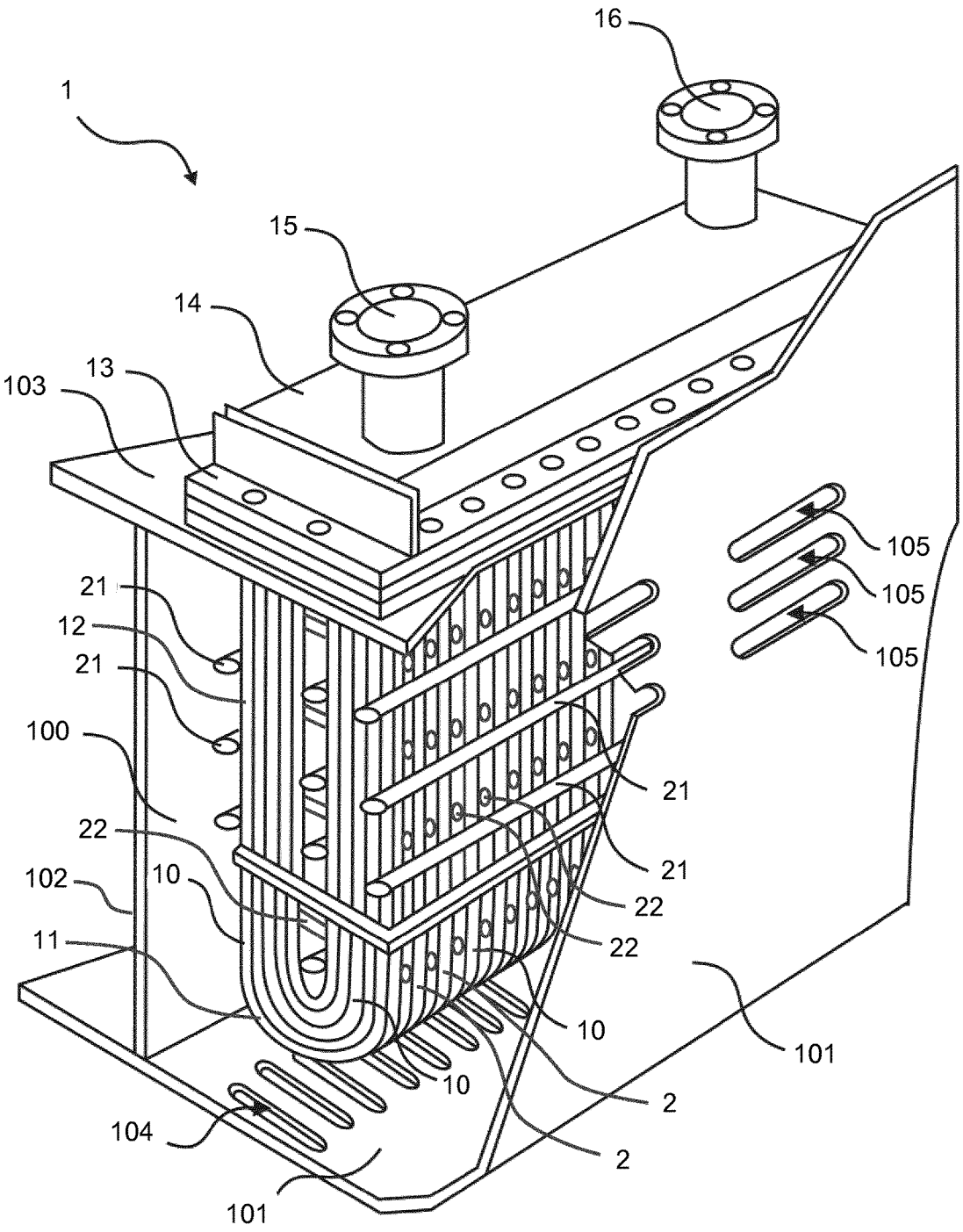
FIG. 1 diagrammatically shows an embodiment of the cooling apparatus according to the invention, comprising a plurality of tubes for containing and transporting the fluid to be cooled in their interior and a plurality of light sources for casting anti-fouling light on the tubes, and furthermore diagrammatically shows a portion of walls for delimiting a compartment in which the cooling apparatus is accommodated.

FIG. 1 shows an embodiment of the cooling apparatus according to the invention, which will hereinafter be referred to as box cooler 1. The box cooler 1 comprises a plurality of tubes 10 for containing and transporting a fluid to be cooled in their interior. The box cooler 1 is intended to be used in an engine-driven ship, wherein the fluid to be cooled is fluid from an engine cooling system of the ship, and wherein the box cooler 1 is enabled to perform its function of cooling the fluid by exposing the tubes 10 of the box cooler 1 to water from the immediate outside environment of the ship, which will hereinafter be referred to as seawater. In particular, the tubes 10 of the box cooler 1 are accommodated inside a compartment 100 of the ship, the compartment being delimited by a portion of the ship's hull 101 and a number of partition plates 102, 103. In the ship's hull 101, a number of entry openings 104 are arranged for allowing seawater to enter the compartment 100 from the outside, and a number of exit openings 105 are arranged in the ship's hull 101 as well, for allowing seawater to exit the compartment 100 and to flow to the outside of the ship. Typically, the entry openings 104 and the exit openings 105 are arranged at different levels, wherein the level of the entry openings 104 is lower than the level of the exit openings 105, assuming a normal, upright orientation of the ship, the compartment 100 and the box cooler 1 in conformity with FIG. 1. For the sake of completeness, it is noted that indications of directions, both explicit and implicit, as used in the following description are to be understood such as to have the normal, upright orientation of the ship, the compartment 100 and the box cooler 1 as mentioned as underlying assumption.

The tubes 10 of the box cooler 1 have a curved shape, particularly a U shape, comprising a curved bottom portion 11 and two substantially straight leg portions 12 extending substantially parallel to each other, in an upward direction with respect to the bottom portion 11. During operation of the box cooler 1, fluid to be cooled, i.e. hot fluid, flows through the tubes 10, while seawater enters the compartment 100 through the entry openings 104. On the basis of the interaction of the seawater with the tubes 10 containing the hot fluid, it happens that the tubes 10 and the fluid are cooled, and that the seawater heats up. On the basis of the latter effect, a natural flow of rising seawater is obtained in the compartment 100, wherein cold seawater enters the compartment 100 through the entry openings 104, and wherein seawater at a higher temperature exits the compartment 100 through the exit openings 105. Also, motion of the ship may contribute to the flow of seawater through the compartment 100. Advantageously, the tubes 10 are made of a material having good heat transferring capabilities, such as copper.

The tubes 10 of the box cooler 1 are arranged in similar, substantially parallel tube layers 2, each of those tube layers 2 comprising a number of tubes 10 of different size arranged in a bundle, wherein a smaller tube 10 is arranged inside of the curved shape of a larger tube 10, so as to be encompassed by a larger tube 10 at a certain distance for leaving space between the tubes 10 in the tube layer 2 where seawater can flow. Hence, each tube layer comprises a number of hairpin-type tubes 10 comprising two straight leg portions 12 and one curved portion 11. The tubes 10 are disposed with their curved portions 11 in substantially concentric arrangement and their leg portions 12 in substantially parallel arrangement, so that the innermost curved portions 11 are of relatively small radius of curvature and the outermost curved portions 11 are of relatively large radius of curvature, with at least one remaining intermediate curved portion 11 disposed therebetween. In case there are at least two intermediate curved portions 11, those portions 11 are of progressively graduated radius of curvature.

Top sides of the leg portions 12 of the tubes 10 are at a similar level in view of the fact that the top sides of the leg portions 12 of the tubes 10 are connected to a common tube plate 13. The tube plate 13 is covered by a fluid header 14 comprising at least one inlet stub 15 and at least one outlet stub 16 for the entry and the exit of fluid to and from the tubes 10, respectively. Hence, the leg portions 12 of the tubes 10 which are at the side of the inlet stub 15 are at the highest temperature, while the leg portions 12 of the tubes 10 which are at the side of the outlet stub 16 are at a lower temperature, and the same is applicable to the fluid flowing through the tubes 10.

During the continuous cooling process of the tubes 10 and the fluid as present in the tubes 10, any microorganisms being present in the seawater tend to attach to the tubes 10, especially the portions of the tubes 10 which are at an ideal temperature for providing a suitable environment for the microorganisms to live in, the phenomenon being known as biofouling. In order to prevent this phenomenon, the box cooler 1 comprises a plurality of light sources 21, 22 arranged in the compartment 100 for casting anti-fouling light on the tubes 10. For example, the light may be UVC light, which is known to be effective for realizing anti-fouling.

In the shown example, the light sources 21, 22 comprise tubular lamps and thereby have a generally elongated shape. The light sources 21, 22 are arranged in a three-dimensional pattern intersecting the pattern of various tubes 10. In other words, the light sources 21, 22 are arranged in the same area as the tubes 10, extending through spaces as present between the tubes 10. In the shown example, the light sources 21, 22 can be classified in two main groups, wherein a first group comprises light sources 21 extending in a direction which is substantially perpendicular to both the tube layers 2 and a direction in which the leg portions 12 of the tubes 10 extend, wherein it is noted that the latter direction will be referred to as main tube direction in the following, and wherein a second group comprises light sources 22 extending in a direction which is substantially perpendicular to both the main tube direction and the direction in which the light sources 21 of the first group extend. In the following, for the sake of clarity, the light sources 21 of the first group will be referred to as first light sources 21, and the light sources 22 of the second group will be referred to as second light sources 22.

In the shown example, the main tube direction substantially coincides with the vertical direction. Hence, both the directions in which the first light sources 21 and the second light sources 22 extend are substantially horizontal directions. In particular, the substantially horizontal direction of the first light sources 21 and the substantially horizontal direction of the second light sources 22 are substantially perpendicular directions. The first light sources 21 intersect the tube layers 2, extending substantially perpendicular to the tube layers 2, and the second light sources 22 are present between the tube layers 2 without intersecting the tube layers 2. For the sake of completeness, it is noted that in the design of the box cooler 1 as shown, the necessary space for allowing for such positioning of the second light sources 22 is present between adjacent tube layers 2.

Figure 2:
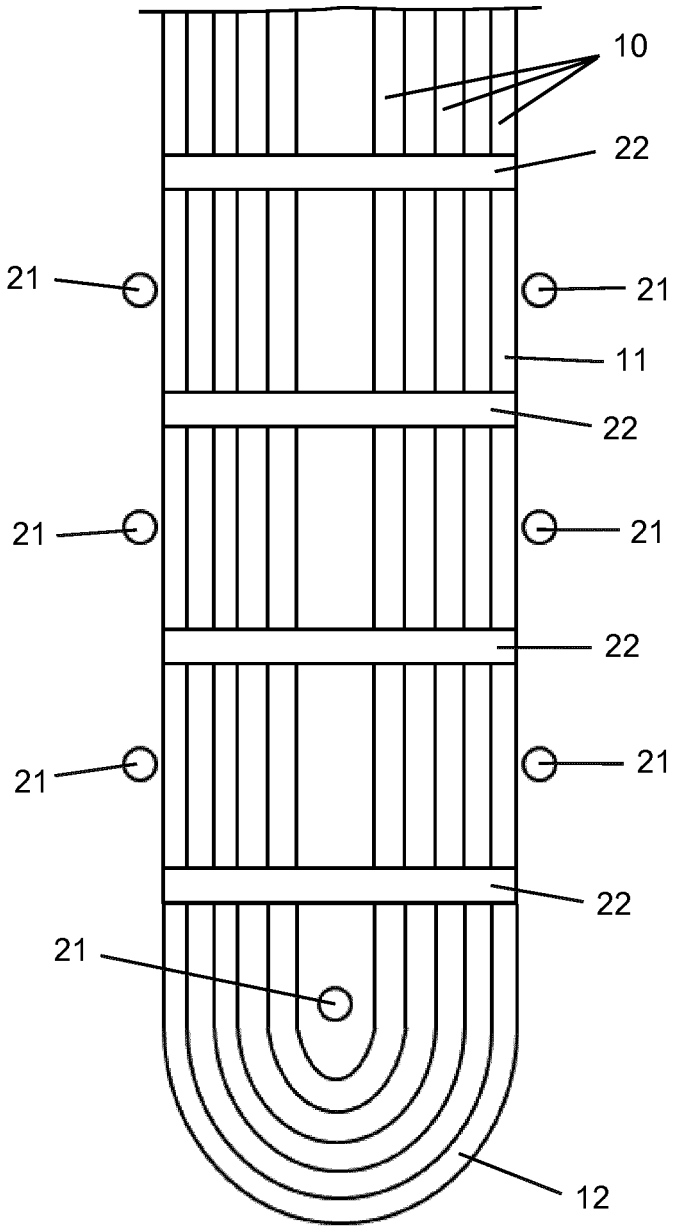
FIG. 2 provides an additional illustration of the positioning of the light sources in the cooling apparatus.

FIG. 2 serves to further illustrate the mutual arrangement of the various light sources 21, 22 and the tubes 10 of the box cooler 1. In the shown example, the length of each of the first light sources 21 is such that the light sources 21 extend all the way from a front tube layer 2 of the box cooler 1 to a back tube layer 2, and the length of each of the second light sources 22 corresponds to the maximum width of the largest tubes 10. That does not alter the fact that the light sources 21, 22 may have other lengths. For example, the first light sources 21 may be approximately as long as half of the distance between the front tube layer 2 and the back tube layer 2, wherein two first light sources 2 may be used for covering the entire distance as mentioned. In particular, the first light sources 21 may be somewhat longer than the entire distance as mentioned or half of the distance as mentioned, so that they may be positioned in the box cooler 1 such as to extend a small distance beyond the front tube layer 2 and the back tube layer 2, respectively. Furthermore, in the shown example, the first light sources 21 are arranged at various levels in the box cooler 1, a number of the first light sources 21 being positioned outside of the U shape of the largest tubes 10, and a number of the first light sources being positioned inside of the U shape of the smallest tubes 10. In that way, it is achieved that anti-fouling light is emitted towards both an inner side of the bundle of tubes 10 in a tube layer 2 and an outer side of such a bundle. The second light sources 22 are arranged at various levels between pairs of two adjacent tube layers 2. It is noted that more light sources 21, 22 may be used, or less, whatever the case may be, as long as the requirement of realizing anti-fouling is taken into account. For example, more first light sources 21 may be applied, wherein first light sources 21 are also arranged outside of the U shape of the smallest tubes 10 and inside of the U shape of the largest tubes 10. When the tube layers 2 comprise more than three tubes 10, it is furthermore possible for the first light sources 21 to be arranged such as to be present in all spaces between the tubes 10 of the various sizes. In any case, it is advantageous if the light sources 21, 22 are spaced equally throughout the box cooler 1.

According to the invention, the light sources 21, 22 are arranged in at least two mutually different orientations in the box cooler 1. Within the framework of the invention, numerous options exist for the size and shape of the light sources 21, 22, for the number of the light sources 21, 22, and also for the positioning of the light sources 21, 22 in the box cooler 1. Also, the size, shape, number and/or positioning of the tubes 10 of the box cooler 1 may be different from what is shown and described in respect of the embodiment of the invention. Hence, the design of the box cooler 1 as described in the foregoing and illustrated in the figures is representative of just one of numerous possible designs. The box cooler 1 should be understood such as to represent no more than an example of a cooling apparatus comprising at least two tubes for containing and transporting a fluid to be cooled in their interior.

It is possible for the box cooler 1 to comprise one or more plates (not shown) at appropriate positions for having an increasing effect on the heat transfer and for directing the light from the light sources 21, 22 towards sides of the tubes 10 which may otherwise remain (mainly) in the shadow. Another possible application of plates in the box cooler 1 may be maintaining the tubes 10 in a fixed spaced relationship with respect to each other throughout their lengths. To that end, plates having apertures for the leg portions 12 of the tubes 10 to pass therethrough may be used.

It will be clear to a person skilled in the art that the scope of the invention is not limited to the examples discussed in the foregoing, but that several amendments and modifications thereof are possible without deviating from the scope of the invention as defined in the attached claims. It is intended that the invention be construed as including all such amendments and modifications insofar they come within the scope of the claims or the equivalents thereof. While the invention has been illustrated and described in detail in the figures and the description, such illustration and description are to be considered illustrative or exemplary only, and not restrictive. The invention is not limited to the disclosed embodiments. The drawings are schematic, wherein details that are not required for understanding the invention may have been omitted, and not necessarily to scale.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. Any reference signs in the claims should not be construed as limiting the scope of the invention. The phrase "a plurality of" as used in this text should be understood such as to mean "at least two".

Elements and aspects discussed for or in relation with a particular embodiment may be suitably combined with elements and aspects of other embodiments, unless explicitly stated otherwise. Thus, the mere fact that certain measures are recited in mutually different dependent claims does not indicate that a combination of these measures cannot be used to advantage.

The term "substantially" as used in this text will be understood by a person skilled in the art as being applicable to situations in which a certain effect is intended which can be fully realized in theory but which involves practical margins for its factual implementation. Example of such an effect include a parallel arrangement of objects and a perpendicular arrangement of objects. Where applicable, the term "substantially" may be understood such as to be an adjective which is indicative of a percentage of 90% or higher, such as 95% or higher, especially 99% or higher, even more especially 99.5% or higher, including 100%.

The term "comprise" as used in this text will be understood by a person skilled in the art as covering the term "consist of". Hence, the term "comprise" may in respect of an embodiment mean "consist of", but may in another embodiment mean "contain/include at least the defined species and optionally one or more other species".

In view of the fact that biofouling does not only occur at sea, but also in rivers, lakes and the like, the invention is generally applicable to cooling by means of any kind of surface water. In this respect, it is noted that in general, the term "surface water" should be understood in the broad meaning of being water which is available on the surface of the Earth, contrary to ground water and atmospheric water.

The invention claimed is:

1. A cooling apparatus for cooling a fluid by means of surface water, comprising:

a plurality of tubes for containing and transporting the fluid to be cooled in their interior, the tubes being intended to be at least partially exposed to the surface water during operation of the cooling apparatus, and a plurality of light sources for producing light that hinders fouling of the exterior of the tubes, the light sources being dimensioned and positioned with respect to the tubes so as to cast anti-fouling light over the exterior of the tubes, wherein the light sources have a generally elongated shape, wherein the light sources are arranged in at least two mutually different orientations in the cooling apparatus, and wherein at least a part of the cooling apparatus has a layered structure in which the tubes are arranged in tube layers, each tube layer including at least one tube, wherein light sources of a first group of the light sources are arranged in an orientation for intersecting at least two adjacent tube layers, and wherein light sources of a second group of the light sources are arranged between at least one pair of two adjacent tube layers without intersecting the at least one pair of two adjacent tube layers.

2. The cooling apparatus according to claim 1, wherein at least a part of the tubes of the respective tube layers a substantially straight part extending in a main tube direction, and wherein the light sources of the second group of the light sources have a substantially straight shape and are arranged in an orientation for extending in a direction which is different from the main tube direction.

3. The cooling apparatus according to claim 2, wherein the light sources of the second group of the light sources are arranged in an orientation for extending in a direction which is substantially perpendicular to the main tube direction.

4. The cooling apparatus according to claim 3, wherein the light sources of the second group of the light sources are arranged in an orientation for being substantially parallel to the tube layers.

5. The cooling apparatus according to claim 4, wherein the light sources of the first group of the light sources have a substantially straight shape and are arranged in an orientation for extending in a direction which is substantially perpendicular to both the main tube direction and the direction of the orientation of the light sources of the second group of the light sources.

6. The cooling apparatus according to claim 1, wherein the light sources of the first group of the light sources extend substantially parallel to each other.

7. The cooling apparatus according to claim 1, wherein the light sources of the second group of the light sources extend substantially parallel to each other.

8. The cooling apparatus according to claim 1, wherein the tubes of the respective tube layers have a curved shape, and wherein at least a number of the light sources of the first group of the light sources are arranged inside of the curved shape of at least a number of the tubes of the respective tube layers.

9. The cooling apparatus according to claim 8, wherein a number of the light sources of the first group of the light sources are arranged outside of the curved shape of at least a number of the tubes of the respective tube layers.

10. The cooling apparatus according to claim 8, wherein the tube layers include a number of U-shaped tubes having a curved bottom portion and two substantially straight leg portions, wherein the tubes of each tube layer have mutually different sizes, ranging from a smallest tube to a largest tube, the smallest tube having a smallest radius of the bottom portion, and the largest tube having a largest radius of the bottom portion, wherein top sides of the leg portions of the tubes are at a similar level in the cooling apparatus, wherein the leg portions of the tubes extend substantially parallel to each other, and wherein at least one light source of the first group of the light sources is arranged inside of the U shape of the smallest tubes of at least a number of the respective tube layers.

11. The cooling apparatus according to claim 1, wherein the light sources comprise a tubular lamp for producing ultraviolet light.

12. The cooling apparatus according to claim 1, wherein the tubes are at least partially coated with an anti-fouling light reflective coating.

13. A ship, comprising:

an engine for driving the ship, an engine cooling system including a cooling apparatus according to claim 1, and a compartment for accommodating the tubes and the light sources of the cooling apparatus, the compartment being provided with at least one entry opening for allowing the surface water to enter the compartment and at least one exit opening for allowing the surface water to exit the compartment.

14. The ship according to claim 13, wherein the interior of walls delimiting the compartment is at least partially coated with an anti-fouling light reflective coating.

* * * * *